US005099778A

United States Patent [19]

Palen

[11] Patent Number: 5,099,778

[45] Date of Patent: Mar. 31, 1992

[54] CRAFT LIFT

[76] Inventor: Richard L. Palen, R.R. 2 Box 683, New Buffalo, Mich. 49117

[21] Appl. No.: 485,525

[22] Filed: Feb. 27, 1990

[51] Int. Cl.[5] ..... B63C 1/02

[52] U.S. Cl. ..... 114/45; 114/48

[58] Field of Search ..... 114/44–51, 114/258, 259; 405/3–7; 187/8.59

[56] References Cited

U.S. PATENT DOCUMENTS 3,338,334 8/1967 Matthews ..... 187/8.59
3,777,691 12/1973 Beale ..... 114/48
3,850,107 11/1974 Klinkhammer et al. ..... 405/7 X
4,773,346 9/1988 Blanding et al. ..... 114/48 X

*Primary Examiner*—Ed Swinehart
*Attorney, Agent, or Firm*—James D. Hall

[57] ABSTRACT

This invention comprises an improved system for raising and lowering an object, most usually a craft, from and into the water. This improved system includes a plurality of pistons, usually disposed at each corner of a rectangular frame, actuated by a remotely disposed valve system which is connected to a common water hose. The pistons are comprised of a pair of cylinders one portion of which is secured to a slip or float and the other portion of which is secured to the craft-supporting rectangular frame. When water is introduced into the system, the craft is raised from the water and when the fluid is evacuated from the system, the craft is lowered.

19 Claims, 8 Drawing Sheets

CRAFT LIFT

BACKGROUND OF THE INVENTION

This invention relates to an improvement in craft-lifts and more particularly in the means for raising a craft from and lowering a craft into, the water.

The term craft is herein used in its broad generic sense and includes all sports and recreational vessels and boats, powered by engine or sail, in general use. For descriptive purposes, the craft lift is herein described and depicted in use with a typical sport cruiser of average length and width. These are not limitations on or to the invention.

It is well known, and has been ever since craft were invented, that continued exposure to the water ultimately deteriorates the hull of such craft. Salt water may be particularly damaging, but even fresh water storage results in the formation of algae and other deleterious matter on the hull.

The ideal circumstance would be to lift the craft from the water and wash down the hull after and between every use of the craft. In normal use, the craft lies still at the dock in the water more than 90% of its life. Many persons can only use their craft on, for example, weekends, and even at that, not every weekend. The craft merely lies in the water, buffeted by tides and winds, accumulating deleterious material and, in effect, rotting away.

This has been, as stated previously, a known problem since watercraft have existed and many solutions have been devised and offered. Countless systems have been conceived, a continuing tribute to the fact that a problem-free solution has not previously been developed.

It is generally conceded that, for the individual sport or recreational boater, a system which incorporates pontoons or floats, positioned on either side of the craft, is the most preferred and desirable. One of the primary reasons that a floating lifting device is preferred over lifting devices which are required to be fixed in relationship to the bottom structure is that the former will accommodate large variations in water levels without having to allow for these variations in the elevating system, and it is independent of the capacity of the bottom structure to accomodate the load. Such a system is normally anchored to the bottom or fixed in some way to a dock.

In these systems, the framework itself is extended between the floats (a term which will be used herein due to the fact that "pontoon" is somewhat restrictive in definition) and supported thereby. The framework may, but does not necessarily, conform to the general configuration of the hull bottom. Its sole purpose is to support the craft and, accordingly, there is little limitation to its shape and configuration. It may be entirely rigid or portions may be of flexible sheet or web materials. A portion, or all, of the framework is raised or lowered with respect to the plane of the water surface, thereby raising the craft from, or lowering it into, the water.

The above referenced principles within the prior art are such a "given" that they need not to be repeated nor exhaustively described. They are only accoutrements of the system and do not represent inventive structure.

The problem with the prior art systems will become obvious upon a viewing of them vis-a-vis the present invention. All of the prior art structures utilize complex chain, or cable, and pulley systems to lift and lower the craft. There is usually a large wheel or a hand crank for the operator to turn.

Such a system is fine for a healthy, vigorous, strong individual, but not all of those capable of operating the vessel have the strength to turn the crank and lift the vessel. These systems are particularly stressful on elderly individuals or those who may be medically or physically handicapped. If there is no one around to assist these individuals, they must do without and wait for assistance. If in a remote location, such assistance may be long in coming, if at all.

Each of the existing devices have additional characteristics which can adversely affect safety, operational costs, and/or the environment. For example:

Systems using cable-pulley arrangements are subject to failure of any component. Separation of cable or pulley during lifting, lowering, and storage (on those not using a mechanical latch to support the stored boat) can cause serious injury to persons or property. Additionally , since most cable systems utilize a single winch and cable, breakage of a cable can result in catastrophic failure.

The primary disadvantages of evacuated float systems are the time and costs associated with the pumping of the tank, the space occupied by the tanks and the depth of the water required for satisfactory operation. For example, a boat which weighs 3000 pounds requires that 360 gallons of water be pumped each time the boat is raised. At a pumping rate of 20 gallons per minute, raising of the boat takes 18 minutes.

Hydraulic systems utilizing petroleum based, or similar fluids are generally quite expensive and limited to commercial use. In order to reduce the cost of componentry, these systems usually operate at pressures approaching, or exceeding, 2000 psi. Failure of a hose or cylinder can cause serious injury to bystanders. Additionally, the escaping hydraulic fluids, either through catastrophic failure or small leaks, has an adverse effect upon waterfowl, marine organisms, and plant life of the waterways.

They may be manual or motorized, more or less complicated, but all are basically the same system. They are portable, self-contained, capable or suplying a plurality of crafts, on water or land, and are of a relatively low cost.

SUMMARY OF THE INVENTION

The present inventions deviates dramatically from the prior art systems, in that is provides a hydraulic system, very simple and comprised of standard components, for raising and lowering the craft.

This system is self-contained, has all of the features desired but un-achieved by others, and may simply be attached to a standard garden hose. That is to say, the system itself is not dependent upon a specific water source.

This invention may be attached to a dock or to floats which may be utilized as a dock. The latter is, of course, preferred, in order that the system may be removed from the water for off-season storage.

This invention combines a floating platform, comprised of a pair of floats, with an elevating lift. A hydraulic system, using potable household water system fluids and pressures, or a small pump using the lake or stream as a source, is the preferred lifting source. The use of low pressure potable water as a hydraulic fluid is made possible by the development of a hydraulic cylinder with a tubular, pressurized piston rod. The pressurization of the piston rod makes it possible to use plastics, which have a low modulus of elasticity, in the construction of the cylinder. Additionally, because the hydraulic fluid (water) is compatible with the environment, some leakage can be tolerated. This permits the use of commercial tolerance plastic pipe for the cylinder. The result is a low cost, energy efficient, non-polluting, lifting device.

This invention utilizes low pressure water, or fluids suitable for potable water system protection (such as anti-freeze) as the hydraulic fluid, and hydraulic cylinders which are primarily non-metallic materials. The hydraulic system is an open system, in that it discharges the fluid from the system when the cylinders are contracted. However, a closed system, which reuses the same liquid, such as anti-freeze, to prevent freezing damage, could also be incorporated.

The hydraulic cylinders develop forces which can be applied directly, or indirectly, to frames, linkages, or flexible members, singly, or in combination, to raise, lower, or translate an object, such as a craft.

The present and preferred form of the invention comprises a valve arrangement to which a garden hose is fitted in standard fashion, and from which a plurality of tubes are extended to a like number of pistons. A fixed portion of each piston is attached to one or the other of two floats and the sliding portion of each piston is attached to respective portions of the structural frame.

When the hose is attached and the water is flowing, the second valve of the system is closed and the first valve of the system is opened and water flows from the valve through the tubing to each piston. This causes the pistons to rise and thereby the structural frame to rise from its lowest to its highest position, or to any position in between. It matters not whether there is a craft present.

A mechanical lock may be used to secure the boat in the stored position. The lock can be manual in engagement and disengagement (preferred), automatic engagement with manual release, or automatic engagement with manual power assisted release. The locking system is constructed so that release cannot be accomplished under load without sufficient pressure in the hydraulic cylinders to support the boat.

If the first valve is then closed and the second valve opened, the water is released from the system and the structural frame is lowered to its lowest position, or to any desired position. The weight of the craft acting on the piston reservoirs is sufficient to empty the system and lower the craft. Indeed, the weight of the structural frame is sufficient to empty the system, it merely takes longer.

It is to be emphasized that there is no auxilliary pressure enhancing unit involved or needed. This system operates on the unadulterated, standard pressure obtained through a common yard or garden-type hose.

In its fully operable form, the craft lift of this invention comprises a pair of mirror-image floats of a buoyancy capable of supporting a craft of a given length, beam and displacement. This is readily and easily calculated, not critical to the invention, and may be designed for craft within various ranges of size.

In the preferred embodiment (a second embodiment will be subsequently explained), the floats contain indentations, vertically extending therethrough, open toward the interior and complementarily disposed so to accomodate structural frame means therebetweeen. It will be understood that the system works even if there are no indentations in the floats. However, the indentations serve to position the lifting device so to reduce the moment, overcome torque (resist overturning of the floats) and, quite simply, make it easier to get into and out of the craft. That portion of the structural frame which supports the craft is very much the same as it would be for a trailer frame or storage frame for the same craft.

More specifically, at that end of the boat lift at which the aft end of the craft will be supported, the structural frame is in the general shape of a flattened "V", conforming to the shape of the hull at the craft. At the end at which the bow of the craft will be supported, the structural frame may be in the more general shape of a sharper "V".

A plurality of piston structures, of which there are generally four and which will be more fully described subsequently, are fixed to the floates at the complementary indentations. Two piston structures at the rear face each other, in vertically movable implementation, and have fixed thereto the appropriate edges of the aforementioned supporting structural frame. Two piston structures at the fore end similarly face each other and have fixed to each of them the appropriate edges of the supporting structural frame.

In their most desirable configuration, the cross-section of the floats are generally rectangular in shape, but this is not an absolute requirement. The reason is that, with the upper face having a flat configuration, each float becomes a dock or platform on which to walk or from which to perform tasks related to the care, maintenance or repair of the craft. When the craft is absent, the floats may be employed just as a normal dock, thereby eliminating the need for a separate dock. If the tops are flat, rather than curved, the floats more readily lend themselves to such use. If the bottoms are flat, they provide greater resistance to tipping when the craft is raised. By comparison to a cylindrical float, the flat bottom surface affords greater displacement, allowing the system to be operated in shallow water. Further, the use of rectangular cross-sectioned floats permits more design flexibility, since the cylinders (pistons) require less vertical movement.

Remotely disposed, such as, for example, on the shore or on a bulkhead or on the float, is the valve system. In actual use, the valve system need not be independently attached or secured. It will be understood that, for sake of description and operability, a relatively simple and straightforward valve system is depicted. The plumbing may be modified without departing from the invention and may include, for example, an anti-siphon valve or other features which may be required by local regulations. Generally speaking, the valve system includes an aperture configured to mate with and receive a standard garden-type hose. Immediately downstream from such a receptacle is located one of the valves. A second valve is located further downstream a sufficient distance so to accommodate (in this embodiment) four barbed tube fittings, the outside diameters of which are approximately one-quarter inch.

To each of the nozzles is fixed a length of one-quarter inch inside diameter plastic hose. In turn, each of the individual hoses is attached to a piston structure. Closing the second valve closes the system. Turning on the water and opening the first valve facilitates the filling of the system with water, thereby raising the piston structure and the thereto attached structural frame.

The structural frame is so configured and constructed that is moves vertically within channelled portions of the piston structure. This ensures that, when a craft is raised, the floats maintain stability and do not move away from each other or rotate. It will, of course, be understood that, when a craft is raised, its weight applies a torque to the floats which has a tendency to cause them to rotate or to push them outwardly and away from the craft.

The shape of the floats, the rigidity of the structural frame, the channels in the piston structure, all contribute to overcome this torque and to maintain the stability of the lift.

An additional feature of this invention is that selective movement of each piston is possible, although the need for individual movement would be rare. However, there are times and situations where it would be preferable to raise the bow higher than the stern or vice versa.

For all pistons to act at the same rate of ascent (or descent) the four hoses must be of approximately the same length. If the hoses to the foremost pistons are of a given length and the hoses to the rearmost pistons are of a greater length, the foremost pistons, and the bow of the craft, will rise at a faster rate.

It is therefore possible to raise either the bow or the stern to a position higher than the other. It is also possible, by disconnecting, for example, the hoses from the valve structure to the rearmost pistons and capping the orifices, to raise only the bow of the craft. Likewise, it is possible to raise only the stern of the craft without raising the bow. This can all be achieved without modification to the configuration or the structure of the system in any fashion other than hereabove mentioned.

The lift of this invention is not limited to a four piston system, but may easily and readily be modified to a six or more piston system. This represents a significant advantage of the water powered hydraulic boat lift, over mechanical systems, in that an almost unlimited number of hoists can be connected. This permits accommodation of larger and longer boats without extensive re-design of the components. That is, structural members can be sized to support, for example, 3000 pounds per cross member and pairs of vertical supports, and a pressure regulator installed to prevent exceeding this limit. Two sets would then be required for a boat weighing 6000 pounds, three, for 9000 pounds, etc. Wider boats, of course, might require increasing the properties of the horizontal cross member. Water consumption is very low, making it practical to connect to most water systems.

This leads to a second embodiment and additional feature of this invention. We have previously described, and will subsequently describe, a system in which each float is unitary. Because the float itself is neither filled nor evacuated, it is sealed tight.

In order to lend versatility and to permit use of three or more pairs, or indeed, of only one pair, of pistons, a shorter float may be utilized. Such a float will be of the same cross-section dimensionally, but will be approximately one half the length of the float described in the preferred embodiment.

Such a float would be symmetrical about each lift piston and would have flat ends to which may be tightly secured another identical float. Such a design is possible because of the uniformity of the lifting forces hydraulically applied at each piston. Providing the lifting mechanism at or near the longitudinal center of each float segment keeps the floats level, as all forces are balanced.

While it is obvious that the preferred embodiment will see the greatest utility, this unique float arrangement provides an added versatility and feature of the invention. It may also be beneficial in these instances where storage space is a problem. Furthermore, individual may add segments merely to extend his basic float to form a larger dock or to form slips wherein to hold a plurality of craft.

By way of example, if the shoreline is very shallow for a considerable distance from the bulkhead, an individual may attach one or more float segments, without lifting devices, from the shoreline to a basic craft lift. Likewise, one or more float segments can be attached beyond the craft lift, merely to extend the "dock" for convenience or to facilitate fishing or swimming. It can be seen, therefore, that this concept of float segmentation gives rise to an unlimited potential.

The invention is aimed primarily at the individual user who may utilize it at his home or cottage on a lake or river and will incorporate the float system. It may be used in a marina or where there are a series of slips, merely by attachment of the pistons to a standard wharf or dock.

There is very critical feature to this system which is so obvious that it may be overlooked, and that is its inherent safety. Since there is no electricity involved, no wiring, no generator, no motor, there is absolutely no danger of fire or electrical shock when the system is employed.

In addition to other features and advantages, the system may readily and safely be used by the elderly or handicapped, due to the fact that there is no more effort involved then turning the valves. Anyone who is capable of operating a garden hose can operate this lift system.

Another feature of the invention is that it may be readily and easily dismantled for storage and transport. Its weight is such that it may be handled by one person, both in disassembly and in movement.

An additional feature of this invention is that it may be used in the research, or treatment, of mammals, such as, e.g., porpoise or whales. Once again, the concept of segmented floats plats an important roll. If relatively small mammals are to be treated, a rather large lift system, capable of raising 2,000–3,000 pounds, is superfluous. For such an application, a single pair of floats, each having a single lift device, may be utilized.

Instead of a rigid support, a flexible web or sheet material may be suspended between the supports. The valve control is attached to or movable with, the floats. One or more operators may move the system into proximity to the mammal, which is then gently floated to a position within the system.

The mammal then may be raised and moved wherever desired, still partially in, or at least in close proximity to, its environment, whether that be an oceanarium or the open sea. For larger mammals, the larger capacity system may be utilized. All features of the invention remain unaltered.

DETAILED DESCRIPTION OF THE INVENTION

Figure 1:
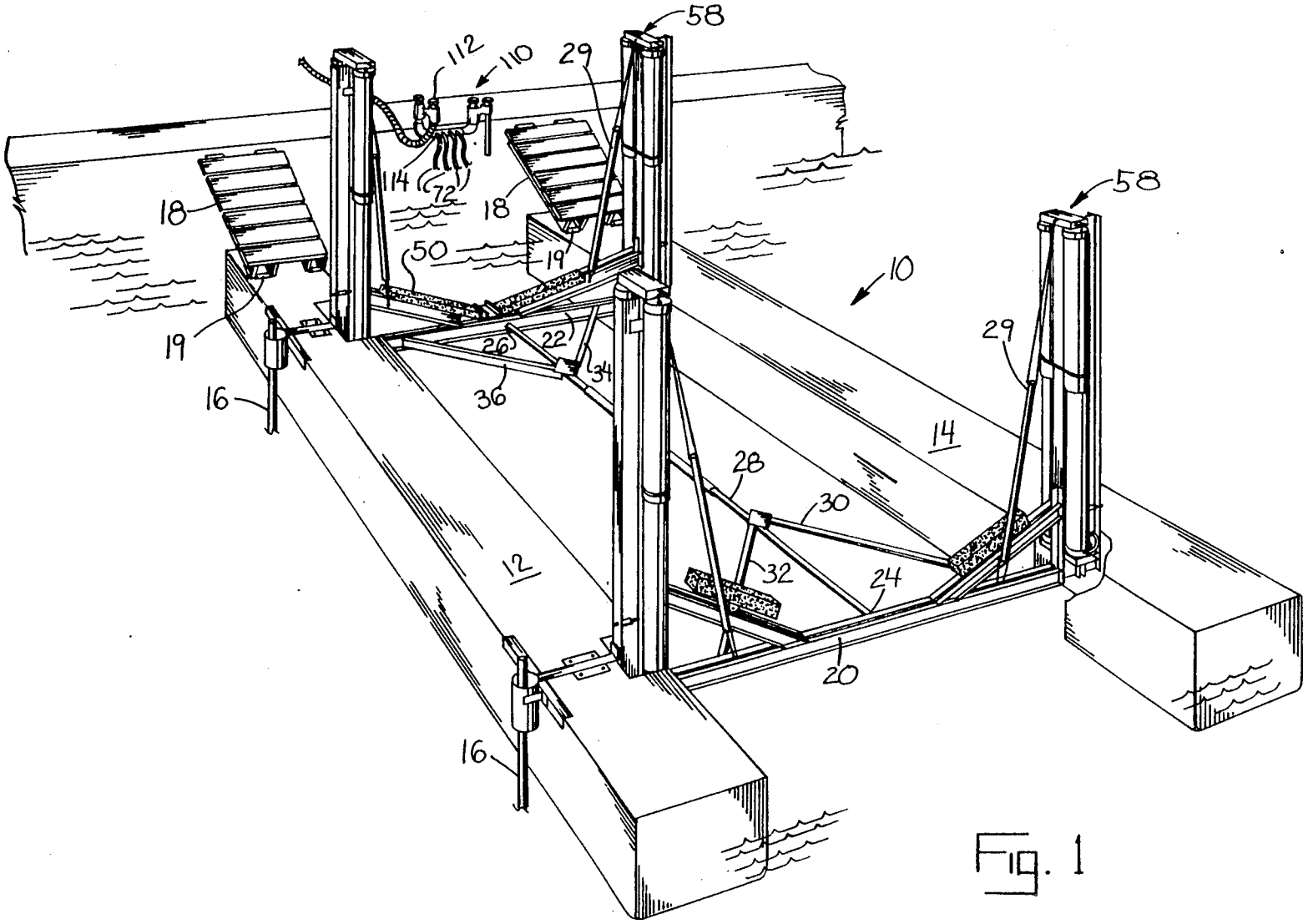
FIG. 1 is perspective view of a craft lift embodying this invention, moored at a bulkhead and in an extended condition.

Referring now to FIG. 1, the craft lift 10 of this invention is depicted as a hydraulic lifting system attached to a floating platform comprised of a pair of floats 12, 14. The general object and purpose is to elevate a craft above the water for long or short term storage.

The framework engages the hull of a craft at two or more points along the hull and, as the framework is raised the craft is raised clear of the water a desired distance.

The framework comprises a pair of horizontal, parallel support members 20, 22, connected together at their center points 24, 26 by an elongated telescoping member 28 of generally determinable length. The support members 20, 22 are preferably I-beams or a structure of similar strength and rigidity. The support members may be reinforced.

The strength and rigidity of the support members is variable to accommodate the size and weight of the craft to be lifted. As previously explained, as the craft is raised, there is a natural tendency for the uppermost portion of the piston structures to bend inwardly toward each other with respect to the lowermost portions of the piston structure, and for the lowermost portions to spread out and away from each other and the craft. This is anticipated by and compensated for within and by the design of the structure, the selection of materials and the reinforcement thereof.

To lend stability to telescoping member 28, four strengthening members 30, 32, 34, 36, which may be Z-sections, I-beams, angles or tubes, are angularly extended, two from each support member, inwardly to and fixed to intermediate points on telescoping member 28. These may be welded or bolted to the members at their respective junctions.

To support member 20 is fixed a craft supporting structure 40. Both sides should be identical, so the following description applies to either. At each remote end of support member 20 is fixed, either by welding or by use of fasteners (e.g., bolts), a short vertical beam 42. To each vertical member 42 is fixed an additional inclined beam 44 which extends inwardly and downwardly toward the center of support member 20, where it is fixed, again by weld or fastener, to such support member.

The other support member, that which will accommodate and support the bow of the craft, will be generally referred to as front support member 22. That which will support the aft end of the craft, will be generally referred to as rear support member 20.

The hull of a water craft will generally have a pointed bow and a relatively flat aft. Also, the front of the hull will generally be of a relatively sharp, V-shape, broadening toward the aft gradually assuming a very shallow, almost flat, V-shape.

To accommodate such a shape, front support member 22 is fitted with a support 50 which differs in configuration from that which is fitted to rear support member 20. These supports need not fit the hull exactly and snugly, but only support it in order that it is held stable and prevented from tipping.

For the front, the mere junction of the angled supports is sufficient to hold the point of the V. As an alternative and if desired, a roller may be positioned at the center. Such rollers are in common use in conjunction with craft transporting trailers.

Reverting to rear support member 20, elongated supports 52 are pivotally attached to the inclined beams by standard means, readily obtainable and which are not a specific part of this invention. These supports are pivotal in order to accommodate the general shape of the hull of the craft to be received. Each vertical member is provided with a flexible bumper 29, which tends to center the craft and to keep it from bumping against cylinders 58.

The above generally described framework may be varied and modified in order to accommodate the shape of an object to be lifted from the water. The present invention does not care what form the structure of the framework takes, so long as it may be attached to the hydraulic means to raise it.

Figure 6:
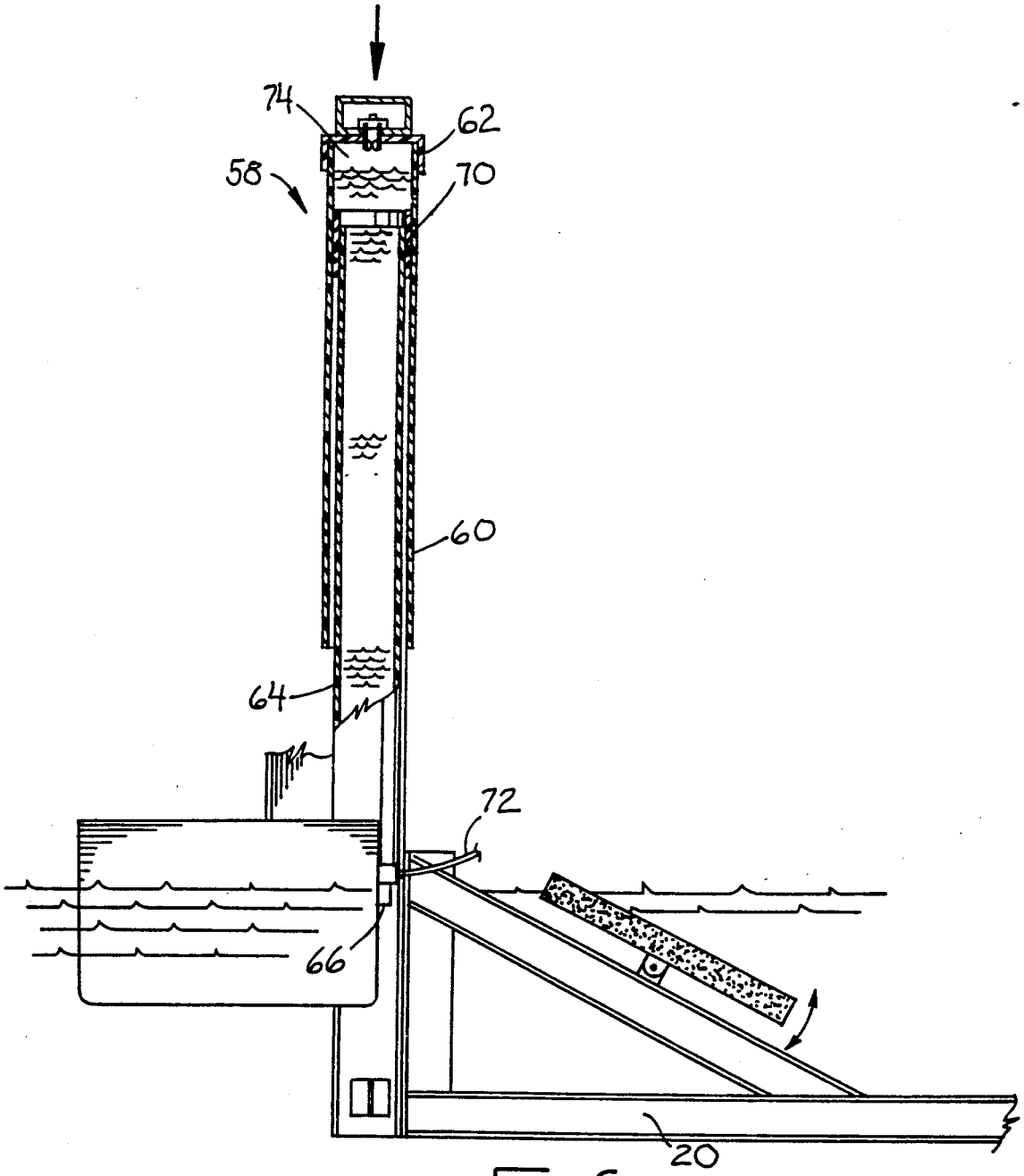
FIG. 6 is an enlarged sectional view of one of the hydraulic cylinders, depicted in its lowered position.
Figure 7:
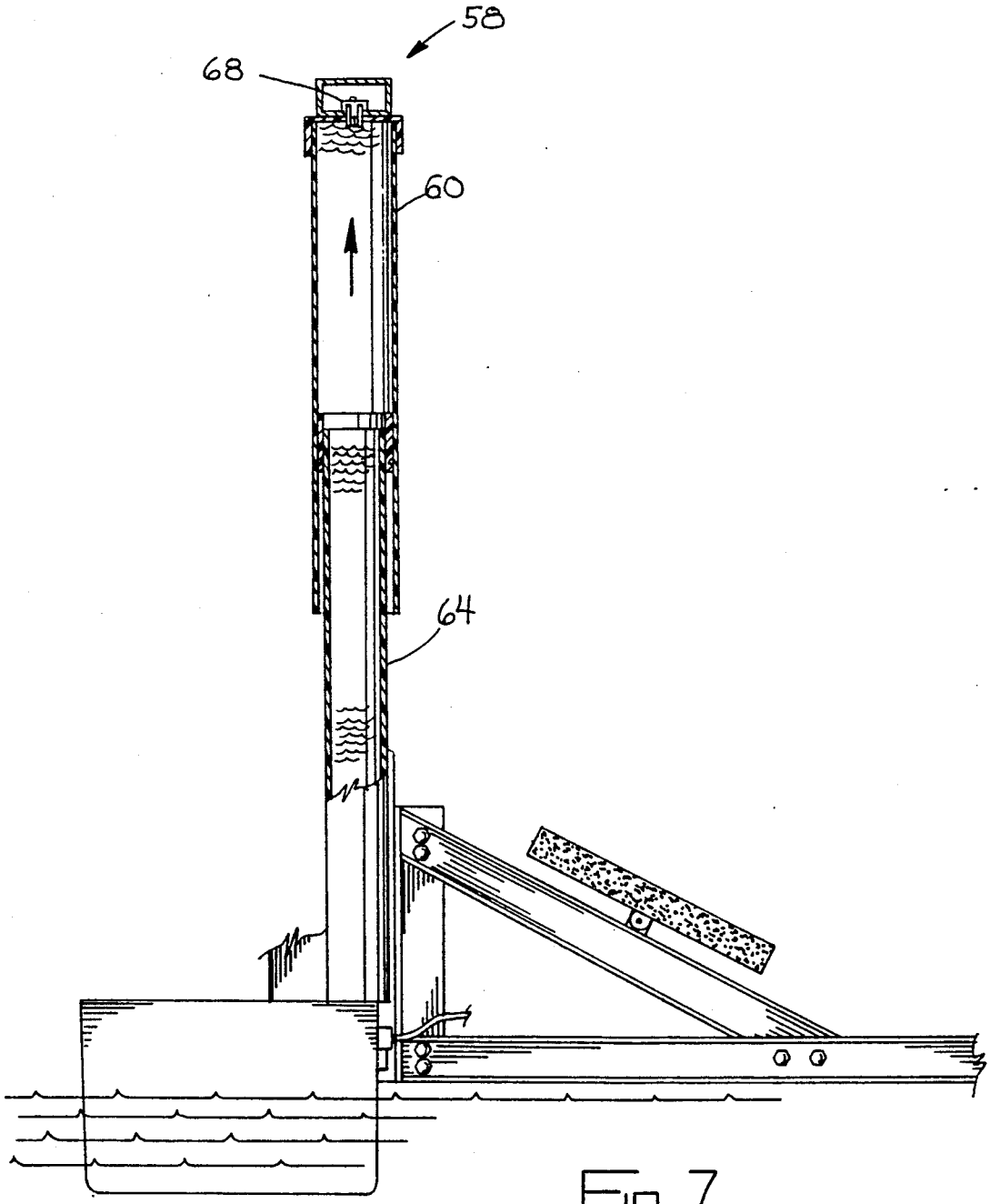
FIG. 7 is an enlarged sectional view of the hydraulic cylinder of FIG. 6, depicted in its raised position.

FIG. 6 depicts the hydraulic cylinder 58 of this invention with a hollow pressurized piston rod. The preferred construction of the hydraulic cylinder is plastic with an elastomer seal. Fittings may be either metal or plastic.

The outer cylinder of the piston assembly consists of a barrel or sleeve 60 and a cap 62. An inner sleeve, with or without seals, may be employed. The inner cylinder of the piston assembly consists of an inner tubular member 64 and a lower cap 66. In order to relieve captive air, the outer cylinder piston cap 62 is fitted with a simple pipe plug 68 to allow venting. The inner tubular member 64 is sealed with an "O" ring(s) 70. The vent of the cylinder assembly is comprised of a supply/drain tube 72.

In operation, pressurized fluid enters the piston rod assembly through the supply tube 72, filling the inner barrel 64 and chamber 74 of outer barrel 60. The pressurized fluid is prevented from flowing from the chamber by the piston O-ring seal 70. When the forces acting against the ends of the cylinder are less than the product of the pressure of the fluid acting over the area of the inner portion of the outer cap 62, and the combined effective area of the seal and piston rod caps, the cylinder extends. When the force acting against the ends is greater, it contracts.

Figure 8:
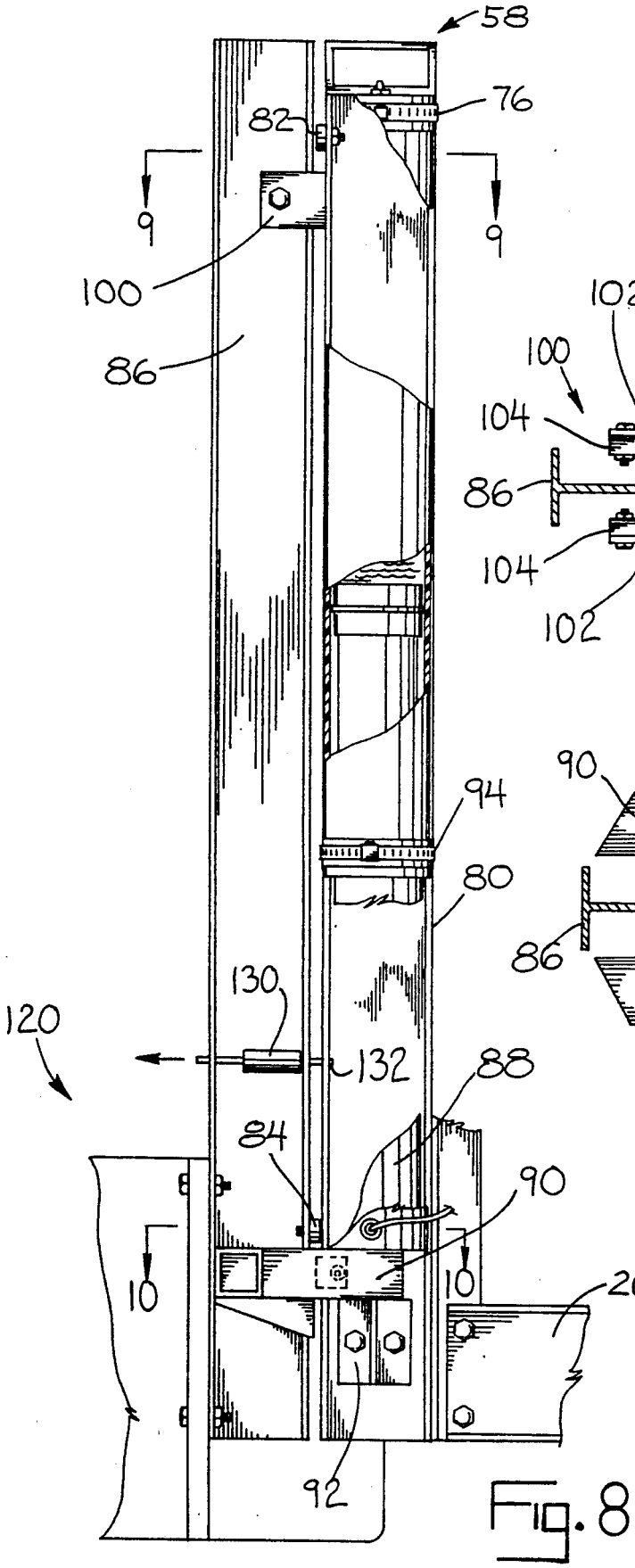
FIG. 8 is an enlarged sectional view of one of the hydraulic cylinder support structures.

As is best illustrated in FIG. 8, the outer cylinder 60 is fixed to I-beam 80 by virtue of clamp 76 and the inner cylinder 64 is fixed to I-beam 86 by virtue of cylinder support 90. Craft support 20, through vertical T-beam 42, is fixed to I-beam 80. Thus it will be seen that I-beam 86 and lower cylinder 64 are fixed in spatial relationship and that I-beam 80 and craft support 20 are vertically movable with relation thereto.

The tubular construction of the piston rod allows the rod to be pressurized. This pressure increases the buckling strength of the piston rod, allowing low modulus materials to be used.

When the cylinder 60 is extended, the frame is lifted until the stop 92 ultimately meets the lower surface of the lower cylinder support 90. This limits the distance of travel of the cylinder and the height of the craft above the water. In order to relieve the pressure on the system, means 130 are provided to latch and support the system in its fully raised condition.

Such a latching mechanism 130 is used to resist inadvertent operation and possible dropping of the boat in the event of a failure of the fluid system. The latching mechanism, that is, one at each piston, supports the entire load in the stored position. The latching mechanism operates between the vertical I-beams.

For purposes of illustration, a simple barrel bolt 132 is depicted. A hole in I-beam 80 aligns with bolt 132 when cylinder support 90 is contacted by stop 92 and the bolt is normally engaged. Water pressure is reduced when locking has taken place. Locks may be designed to resist accidental unlocking when the cylinders are not pressurized.

By way of example, and not as a limitation, cylinders have been constructed and will be explained with reference to a single cylinder, as all are identical. The cylinder 58 is made of two schedule 40 PVC pipes 60, 64, one of 3" nominal diameter (64) and the other of 4" nominal diameter (60). The 4" pipe has a pressure rating of 220 psi, the least of the components. The effective piston area is approximately 12.55 inches square. At the rating of the outer tube (220 psi) the cylinder would be capable of exerting a force of 2761 pounds.

However, typical household water systems have a maximum pressure of approximately 60 psi. At 60 psi the cylinder will exert a force of 753 pounds.

Each cylinder would require only about ⅔ gallon of water for each foot of lift. Eight cylinders, lifting 24 inches, would require about 10.4 gallons. If lifting is accomplished in 5 minutes (to provide smooth lift) consumption is only at about 2 gallons per minute.

FIG. 8 illustrates one of a pair of twin hydraulic cylinders 58 mounted to an I-beam 80 by virtue of clamp 76. As previously explained, outer cylinder 60, being fixed to I-beam 80 and to craft support 20, rises with respect to I-beam 86, to which is fixed, by virtue of lower support 90, inner cylinder 64. In order to ensure the verticality of movement, two spacers 82 are attached to I-beam 80 near its top portion. Complementary spacers 84 are attached to the lower portion of I-beam 86. At the lower end of outer cylinder 60 is fixed a spacer 94, which has a thickness approximating the thickness of spacers 82, 84.

Figure 9:
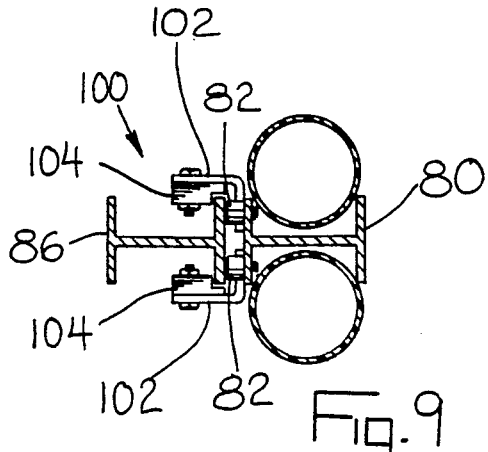
FIG. 9 is a cross sectional view of the structure of FIG. 8, taken along line 9—9 thereof.

In addition, as best illustrated in FIG. 9, there is a support 100, which is fixed to I-beam 80 and which rides up and down the flange of I-beam 86. Support 100 consists of two L-shaped members 102 fixed to I-beam 80 to form a general C-shape. Obviously, a C-shaped member might be used, but the use of L-shaped members permits manual adjustment to more closely conform support 100 to I-beam 86. At the extreme outer ends of member 102 are fixed two spacers 104, notched to generally receive and encompass the flange of I-beam 86. As cylinder 60 rises and lowers vertically, support 100, in conjunction with spacers 82, 84 and spacer 94, ensures that the motion is smooth and essentially vertical. It will be understood, of course, that rollers may be used rather than simple spacers.

Vertical movement is limited by reason of stop 92 rising into engagement with cylinder support 90. At this point in time, latching mechanism 130 is manually actuated.

Figure 2:
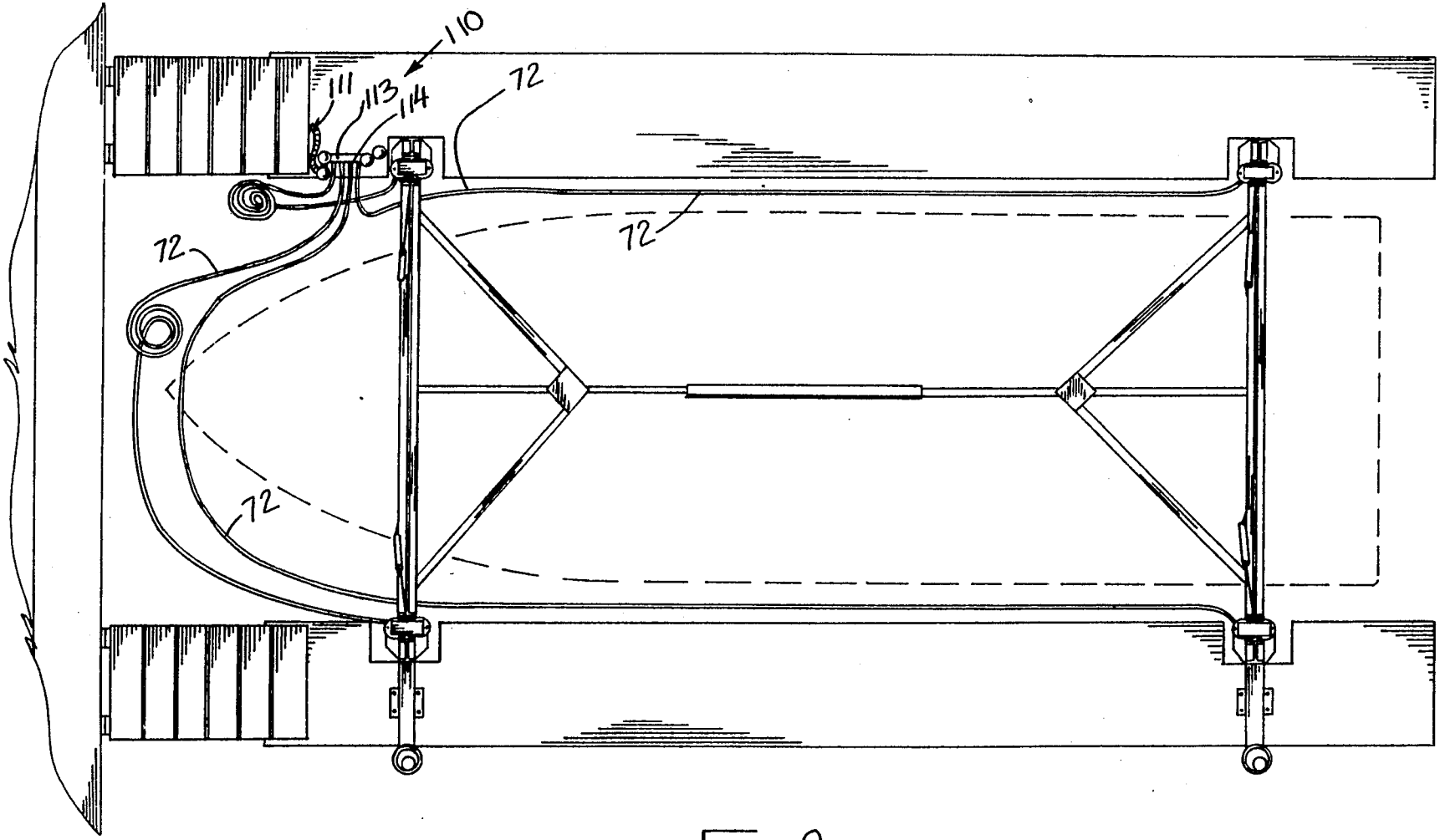
FIG. 2 is a plan view of the system of FIG. 1, supporting a craft (shown in broken lines).
Figure 3:
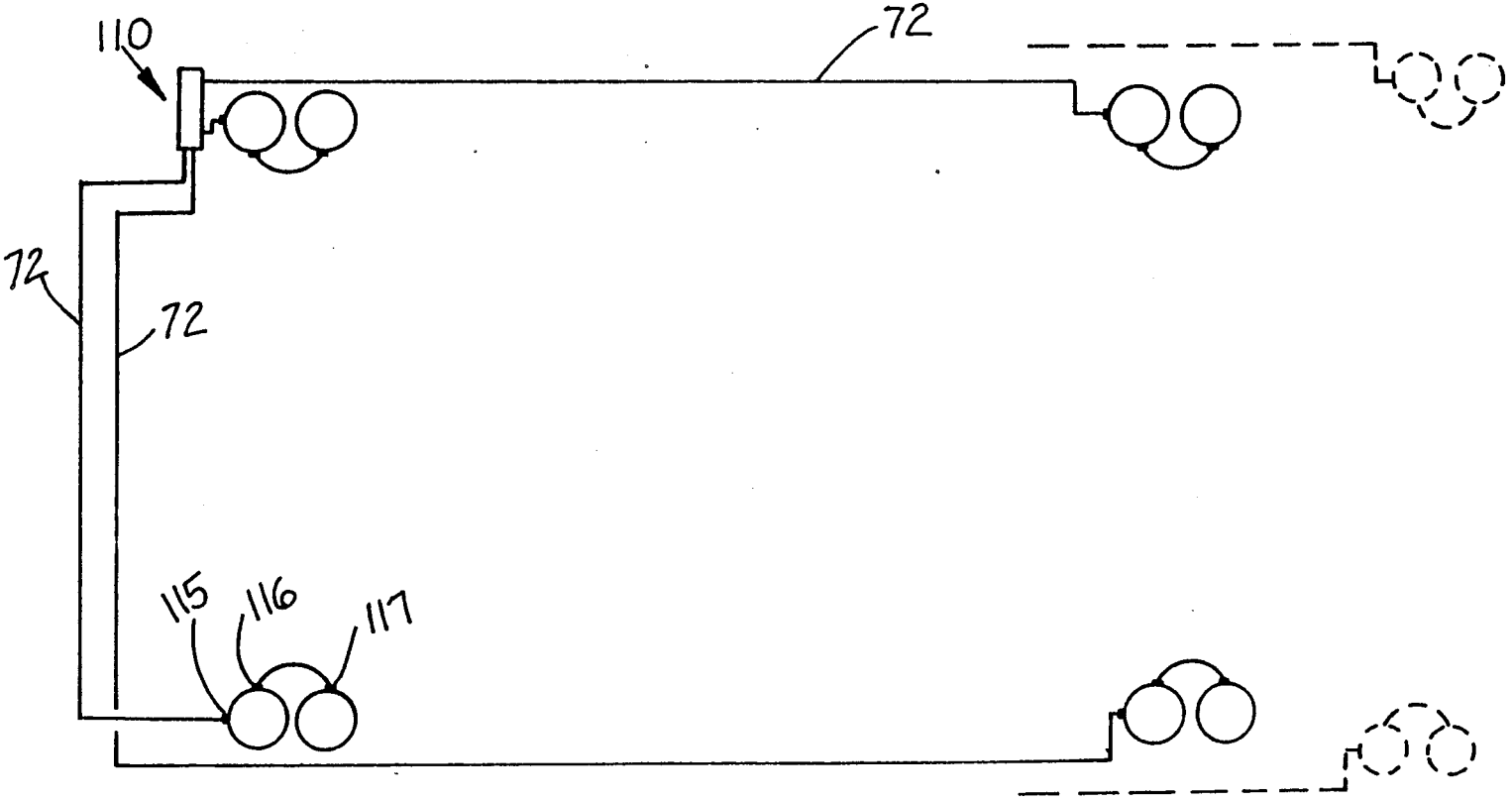
FIG. 3 is a diagrammatic view of the hydraulic system of the invention.
Figure 4:
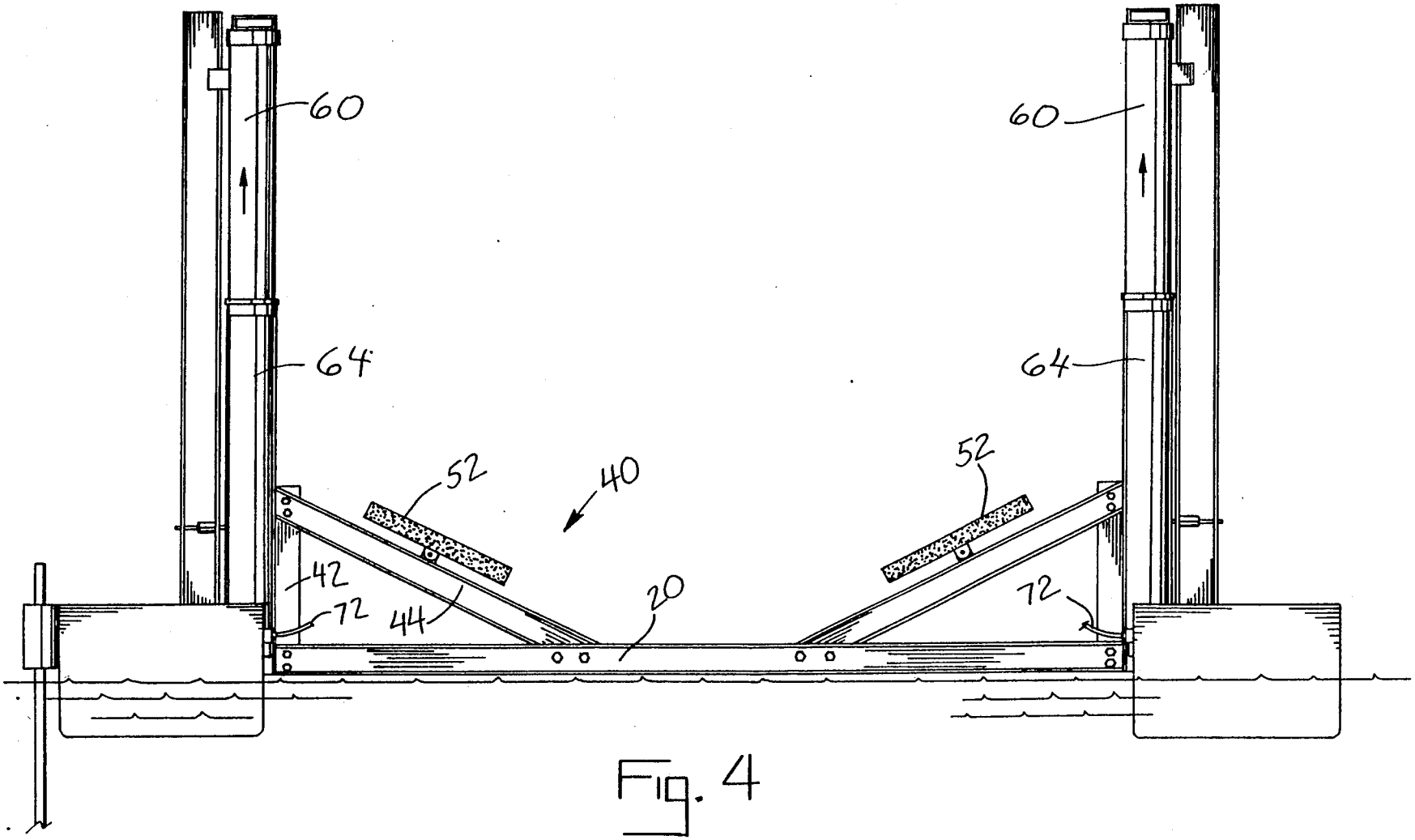
FIG. 4 is an end view of the aft supporting structure in its raised position.
Figure 5:
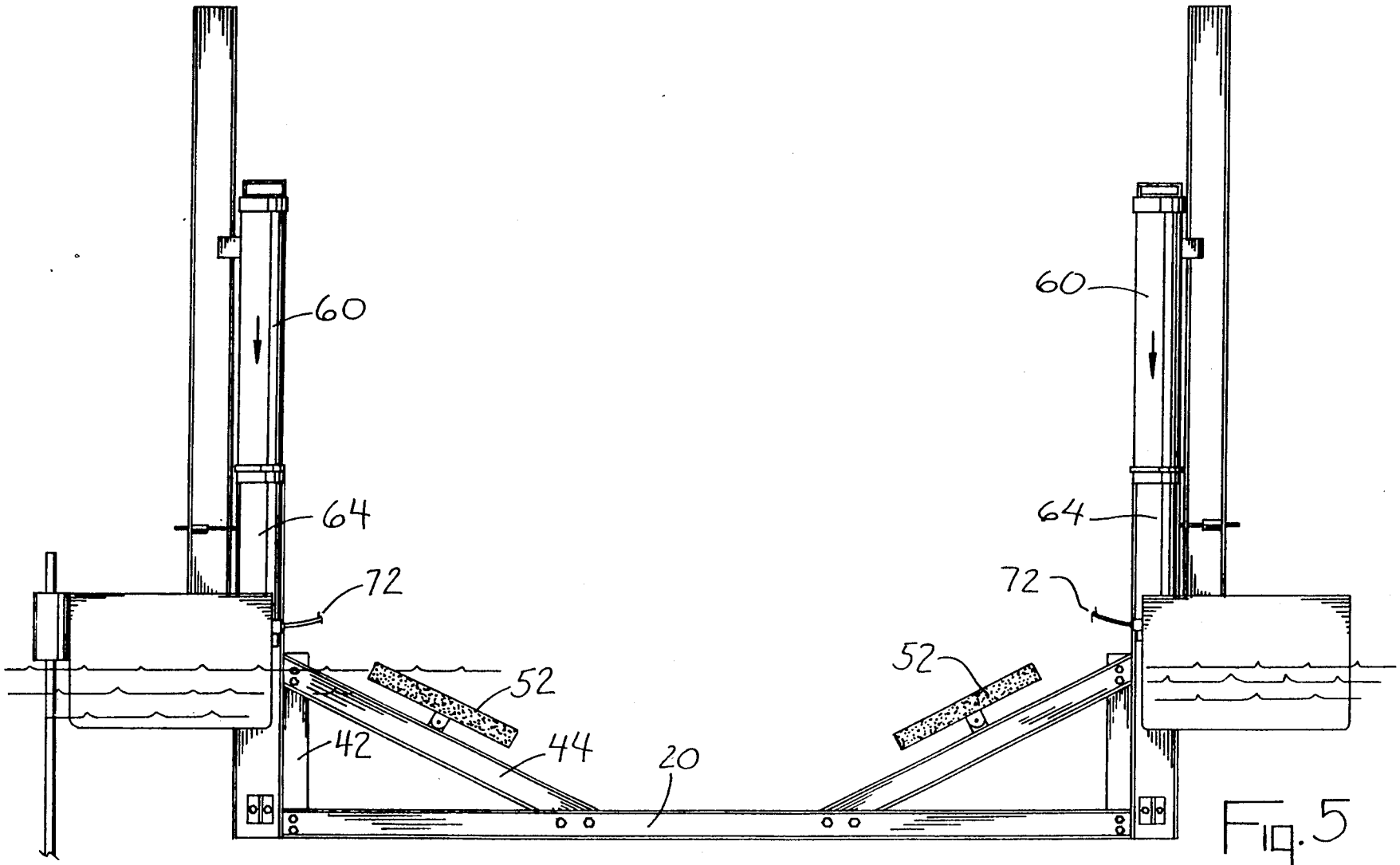
FIG. 5 is an end view of the aft supporting structure in its lowered position.

The typical piping arrangement is illustrated in FIGS. 2 and 3. A typical two support system is shown in solid lines. Additional piping suggested in dotted version for additional supports. Addition of supports and cylinders increases the overall capacity of the system, allowing almost any weight or size pleasure craft to be accommodated. Most lifts of craft will be only a very short distance, essentially approximating the draft of the craft. On this basis, it is not anticipated that flow control, throttling, or pressure limiting devices will be required. However, in some cases such devices, including some with feedback controls may be required.

The valve 110 is not illustrated in detail. The valves themselves and the fittings are standard and commercially available. It will be noted that, in FIG. 1, the valve is illustrated as attached to the bulkhead, while in FIG. 2 it is illustrated as mounted on one of the floats. This merely indicates that the location is a matter of choice. Water is introduced into the valve at hose connection 111. A short length of piping 113 extends horizontally from the first valve 112. Piping 113 contains, in this illustration, four nipples, or outlets 114, to which are attached four supply/drain tubes 72. Tubes 72 extend from valve 112 to the cylinders 58. Since the connections and fittings are the same, only one will be described in detail.

As previously explained, each station includes two cylinders 58 fixed to and positioned at either side of I-beam 80. Since the pressure exerted will be equal, there is no need to supply water independently to each cylinder. One cylinder is provided with a nipple, or outlet 115, to which is attached one of tubes 72. This piston is also provided with a second nipple 116 for inter-connection to the second piston, which is provided with a nipple 117.

Figure 10:
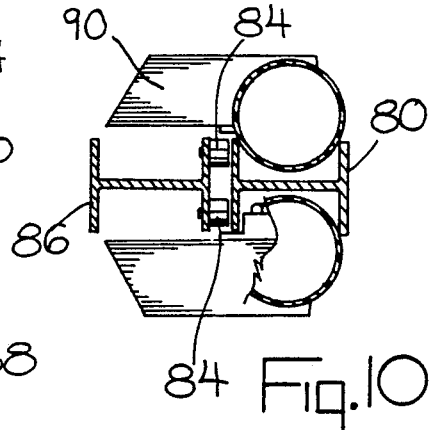
FIG. 10 is a cross-sectional view of the structure of FIG. 8, taken along line 10—10 thereof.

Attached to the float, adjacent to the boat support assembly member is the vertical guide member assembly 120, best illustrated in FIG. 8. Near the lower end of I-beam 86 are lower cylinder supports 90. The guide and bearing block assembly, depicted in FIGS. 9 and 10, tend to maintain parallel movement of the vertical boat support member and the vertical guide member.

Hydraulic cylinders are placed on each side of the vertical boat support assembly member 80. Upper cylinder 60 is clamped in place with its upper end resting against I-beam 80. Lower cylinder 64 is in contact with lower cylinder support 90, which is fixed to I-beam 86. The hydraulic cylinder, which is made of non-metallic materials, extends whenever the product of the effective area and the pressure exceeds the load being imposed. Over-extension of the cylinder is prevented when stop 92, at the lower end of vertical boat support member 20, engages the lower surface of lower cylinder support 90. It should also be mentioned that this stop arrangement reduces considerably the stresses in the vertical guide member which would be imposed if the stop were located somewhere along the vertical guide member.

Since only a small amount of fluid is required, flow rates are not critical. Additionally, the floats require the boat to be lifted only a small distance above the water, as it is not necessary to allow, within the lift mechanism, for fluctuations in levels of the water in the body of water in which the system is being used.

Pressure controls can be used to limit the lift capacity of the cylinders to specific amounts. This feature, combined with the floating platform, permits connecting as many lift assemblies as necessary to lift a boat. For example, at least two lifts are required. Assuming that each lift uses two cylinders at each end of a boat support, and that the effective area of each cylinder is 12.5 square inches. A pressure limitation of 50 psi would limit each cylinder to 625 pounds, or 2500 pounds per lift assembly. Therefore, two boat support assemblies would have a capacity of 5000 pounds, three- 7500 pounds, four- 10,000 pounds. Floatation and structures are sized with respect to lift capacity. Other than possibly some redesign of the horizontal boat support assembly member, because of the longer span, little redesign would be necessary to accommodate larger boats.

When the piston reaches its highest level, that is, when it meets the stopping arrangement, the craft is fully removed from the water into its storage position. To eliminate the need for pressure within the system during storage and to support the craft for periods of time, support mechanism 130 is provided.

In its simplest form, such a mechanism may be comprised at a simple bolt lock, located near the base of vertical guide member 86. For simplicity and reliability these locks preferably are manually insertable into and through the openings provided therefore. It is however, a mere matter of design choice to provide bolt locks which are spring actuated and which will actuate into the locking position when the opening is raised to mate with the bolt.

The boat lift of this invention has been described and illustrated in combination with a pair of floats 12, 14, and that is the preferred embodiment. This has previously been explained, but the basic reason is that the floats may be used as replacements for a dock or pier. In position in the water at the desired location, the float may be secured by use of posts 16 which are driven into the water bottom.

Ingress and egress are provided by a conventional walkway or gang plank 18 which is fixed to the bulkhead and which extends over the float (there will normally be one for each float). The walkway includes a roller or wheels 19 at the end in order to prevent damage to the float and to compensate for wave action, tidal action, or the like, and to permit ready movement of the float in a vertical direction when the boat lift is in use.

It will be obvious, however, that such an arrangement is aimed toward the individual owner and user. If there is an existing dock or a plurality of adjacent slips in a marina, the system is equally usable and desirable. Means for attachment to the floats has been described and illustrated. However, the cylinders may be attached to a stationary dock and will work in the same fashion as when fixed to the floats.

Indeed, all marinas have a supply of water and hoses to wash down the craft. This system is ideal for a marina and operates in such an environment with very little adaptation.

In operation, reverting to the individual and the combination of the lift with floatation devices, the boat lift is located at the waterfront and anchored to the bottom.

The second valve is opened in order to ensure that all of the water is flushed from the system and the supporting framework is at its lowest point, relatively speaking. The craft is maneuvered into position and the second valve is closed, in order to close the system.

The hose is connected and the valve system is closed by operation of the second valve. The water is turned on and the first valve is opened to introduce water. The cylinders are filled and the pistons, to which the framework is attached, rise in relative unison, raising the craft. When the craft is raised sufficiently, the pistons are stopped by encountering stopping means.

The bolts are inserted at each cylinder and the craft is in its storage condition. In order to relieve the pressure on the various parts of the system, especially for long duration storage, the valve may be opened to atmosphere and water flushed from the system.

When it is desired that the craft be put to use, the system is closed and sufficient water re-introduced to ensure that the craft is fully supported. The bolts are extracted while the cylinders are under pressure, the first, or fill, valve is closed, and the second valve is opened to flush the system. The weight of the craft acting against the pressure of the system, very slowly and gently lowers itself into the water.

When the craft is floating freely, it is merely lashed to a post for securement or boarded and driven away.

The weight of the floats and of the entire system is such that it can readily be hauled onto dry land for winter or any sustained storage period, or it may readily be disassembled for storage.

It will be understood that the invention is not to be limited to the precise form disclosed in the preferred embodiment but may be modified without departing from the scope of the invention as defined by the appended claims.

I claim:

1. A lift and storage system which comprises a plurality of vertically disposed piston means attached to longitudinally extending frame means for supporting an object to be lifted, each of said vertically disposed piston means supported on a pair of beams, one of said beams being adapted to be fixed to a relatively stationary support means, the other of said beams being connected in slidable relationship to said one beam and being fixedly attached to said longitudinally extending frame means, each of said vertically disposed piston means including two vertically oriented cylinders telescopically movable with respect to each other, the uppermost of each said two cylinders being sealed at the top and open at the bottom and the lowermost of each said two cylinders being sealed at the bottom and open at the top in order to form a closed chamber, the lowermost of each said two cylinders being fixedly attached to said one of the beams and the uppermost of each said two cylinders being fixedly attached to said other of the beams, one of each said two cylinders including an opening therein for the introduction and release of fluid, such that, upon the introduction of fluid into said piston means, said other beam and said frame means are movable with respect to said one beam.

2. The system of claim 1 including valve means whereby to control the introduction of fluid to and the discharge of fluid from said piston means and hose means for the passage of fluid from said valve means to said piston means.

3. The system of claim 1 wherein said frame means are structurally rigid and adapted to generally conform to the shape of the object to be lifted.

4. The system of claim 1 wherein said support means to which said one of said beams are secured is a pair of longitudinally extending floats such that said frame means is disposed between said floats.

5. The system of claim 4 wherein said floats are generally rectangular in cross-section, the upper surface of which serves as a dock or platform.

6. The system of claim 4 wherein, upon introduction of fluid into said piston means, said frame means rise vertically with said uppermost cylinders relative to said floats and said lowermost cylinders.

7. The system of claim 1 wherein said one of said beams are secured to longitudinally extending supports between which said frame means is disposed.

8. The system of claim 7 wherein, upon introduction of fluid into said piston means, said frame means rise vertically with said uppermost cylinders relative to said supports and said lowermost cylinders.

9. The system of claim 1 further including means to stop the vertical movement of said piston means after a predetermined rise.

10. The system of claim 1 further including means to secure said lift system in its fully raised condition.

11. The system of claim 1 wherein said fluid is introduced at a pressure of between 40 and 70 psi.

12. The system of claim 1 wherein said fluid is introduced at a pressure of 60 psi.

13. The system of claim 1 wherein said frame means is generally rectangular in shape and wherein four of said piston means are fixed thereto, one at each corner of said frame.

14. The system of claim 1 wherein said frame means is of an elongated rectangular shape and wherein a plurality of piston means are fixed thereto, at each corner of said frame and at a plurality of evenly spaced intermediate points thereof.

15. A craft lift and storage system which comprises longitudinally extending frame means for supporting a craft during the raising and lowering of said craft, a pair of longitudinally extending floats disposed at each of two sides of said frame means for buoyantly supporting said frame means, at least four vertically disposed piston means, located at least at the four corners of said frame means, each of said piston means being supported on a pair of beams, one of said beams being secured to said float, the other of said beams being connected in a slidable relationship to said first beam and being fixedly attached to said frame means, each of said piston means further including two cylinders telescopically movable in a vertical direction with respect to each other, the uppermost cylinder of each piston means being sealed at the top and open at the bottom and the lowermost cylinder of each piston means being sealed at the bottom and open at the top in order to form a closed chamber, the lowermost cylinder of each piston means being secured to said one of the beams and the uppermost cylinder of each piston means being secured to said other of the beams, one of said uppermost and lowermost cylinders of each piston means including an opening therein into said chamber for the introduction and release of fluid, valve means remotely disposed from and having independent connection to each of said piston means and to a source of fluid for control of fluid into said piston means through said cylinder opening, whereupon, on the introduction of fluid into said pistons means, said cylinders are telescopically extended, each from the other, causing said frame means to rise vertically with said uppermost cylinders to raise said craft, and means to halt the rise of said frame means upon its reaching a desired level.

16. The system of claim 15 whereby, upon actuation of said valve means to evacuate the fluid from said piston means, said craft is lowered.

17. The system of claim 15 wherein said fluid is introduced at a pressure of between 40 and 70 psi.

18. The system of claim 15 wherein said fluid is introduced at a pressure of 60 psi.

19. The system of claim 15 wherein said floats are generally rectangular in cross-section, the upper surface of which serves as a dock or platform.

* * * * *